US006029616A

United States Patent [19]

Mayne et al.

[11] Patent Number: 6,029,616

[45] Date of Patent: Feb. 29, 2000

[54] FREE PISTON ENGINE

[75] Inventors: Alfred R. Mayne; Alan P. Casey, both of Arundel, Australia

[73] Assignee: Split Cycle Technology Limited, Arundel, Australia

[21] Appl. No.: 08/945,257

[22] PCT Filed: Apr. 16, 1996

[86] PCT No.: PCT/AU96/00222

§ 371 Date: Feb. 14, 1998

§ 102(e) Date: Feb. 14, 1998

[87] PCT Pub. No.: WO96/33343

PCT Pub. Date: Oct. 24, 1996

[30] Foreign Application Priority Data

| | | | |
|---|---|---|---|
| Apr. 20, 1995 | [AU] | Australia | PN 2486 |
| May 3, 1995 | [AU] | Australia | PN 2767 |
| Feb. 15, 1996 | [AU] | Australia | PN 8079 |

[51] Int. Cl.[7] ..... F02B 71/04

[52] U.S. Cl. ..... 123/46 R

[58] Field of Search ..... 123/46 R, 46 A, 123/46 B, 46 H, 46 SC

[56] References Cited

U.S. PATENT DOCUMENTS

| | | | |
|---|---|---|---|
| 3,119,230 | 1/1964 | Kosoff . | |
| 3,841,797 | 10/1974 | Fitzgerald | 123/46 R |
| 3,905,339 | 9/1975 | Wallis | 123/46 R |
| 4,016,719 | 4/1977 | Yavnal et al. . | |
| 4,057,040 | 11/1977 | Wax | 123/46 R |
| 4,085,710 | 4/1978 | Savarimuthu . | |
| 4,308,720 | 1/1982 | Brandstadter | 123/46 R |
| 4,530,317 | 7/1985 | Schutten . | |
| 5,146,880 | 9/1992 | Mayne . | |
| 5,279,209 | 1/1994 | Mayne . | |
| 5,473,893 | 12/1995 | Achten et al. | 123/46 SC |
| 5,540,194 | 7/1996 | Adams | 123/46 R |

FOREIGN PATENT DOCUMENTS

| | | |
|---|---|---|
| 057 300 | 8/1982 | European Pat. Off. . |
| 183 258 | 6/1986 | European Pat. Off. . |
| 4024-591 | 6/1992 | Germany . |

*Primary Examiner*—Marguerite McMahon

*Attorney, Agent, or Firm*—Snell & Wilmer LLP

[57] ABSTRACT

A free piston engine wherein a combustion piston directly drives a pumping piston to pump hydraulic fluid to and fro to a linear to rotary motion pump/motor converter which is in the form of a "split cycle" machine.

20 Claims, 5 Drawing Sheets

FREE PISTON ENGINE

TECHNICAL FIELD

The present invention relates to varying the control of piston motion and in particular to methods and means for varying the stroke of a free piston in a cylinder during a cycle of operation of piston-in-cylinder motion.

BACKGROUND ART

A free piston engine essentially combines the principles of combustion and hydraulics into one engine. Combustion expands, pushing a 'combustion' piston which is rigidly attached to a "pumping piston" which together constitute the 'free' piston. The pumping piston pumps the hydraulic fluid through the power lines to a number of pump/motors which can be used in may applications.

SUMMARY OF THE INVENTION

The present invention has application to free piston-in-cylinder motion of an internal combustion engine which by means of the present invention is essentially facilitated by providing a hydraulic coupling between a chamber swept by a piston rod of a free piston internal combustion engine, the piston rod undergoing linear motion in that chamber and one or a plurality of working chambers of a rotary machine of the general form shown in our U.S. Pat. Nos. 5,146,880 and 5,279,209 but not limited to the specifics of the embodiments as shown in-those specifications.

In particular, a machine having a primary axis and comprising:

a plurality of radially reciprocable pistons disposed radially of said primary axis: and a circular array of lobed shafts constrained for orbital motion about said primary axis, each shaft being rotatable about a respective secondary axis parallel to the primary axis, the shafts being rotatably driven by drive means at a rate being a predetermined proportion of their orbital rate, and the planes of the lobes lying approximately in the radial plane of the pistons, and wherein during the rotation and orbit of the shafts and reciprocation of the pistons each piston is connected with at least one lobe for rotation and orbit of the shaft in unison with reciprocation of that piston, or, in an alternative, a machine having a primary axis and comprising:

a plurality of radially reciprocable pistons disposed radially of said primary axis; and a circular array of lobed shafts constrained for orbital motion about said primary axis, each shaft being rotatable about a respective secondary axis parallel to the primary axis at a rate being a predetermined proportion of their orbital rate, and the planes of the lobes lying approximately in the radial plane of the pistons, and wherein during the rotation and orbit of the shafts and reciprocation of the pistons each piston maintains substantially continuous contact with at least one lobe throughout each cycle of reciprocation of that piston; or, in an alternate embodiment, a machine having a primary axis and comprising:

a plurality of radially reciprocable pistons disposed radially of said primary axis; and a circular array of lobed shafts constrained for orbital motion about said primary axis, each shaft being rotatable about a respective secondary axis parallel to the primary axis at a rate being a predetermined proportion of their orbital rate, and the planes of the lobes lying approximately in the radial plane of the pistons, and wherein during the rotation and orbit of the shafts and reciprocation of the pistons each piston maintains substantially continuous contact with at least one lobe throughout each cycle of reciprocation of that piston; and in connection with any of the forgoing embodiments, there is a transition without substantial time delay, between each successive cycle of reciprocation of each piston defined by the period between contact and separation of respective successive lobes and said piston and wherein said pistons are arranged in pairs, the pistons of each said pair pumping fluid from one to the other in response to piston reciprocation so as to maintain substantially asynchronous reciprocation of the pistons of each pair is hereinafter referred to as a "split-cycle" machine.

The contents of U.S. Pat. Nos. 5,146,880 and 5,279,209 are incorporated herein by reference. In an arrangement of the present invention, the output of the combination is via the central rotary shaft of a rotary machine of our known type.

In one aspect the present invention provides a method for converting linear piston motion to rotary motion in a free piston engine comprising at least one free piston formed by a combustion piston and a pumping piston wherein the pumping piston pumps hydraulic fluid to at least one hydraulic pump/motor which converts the motion of said hydraulic fluid to rotary output motion and wherein said pump/motor is a "split-cycle" machine as hereinbefore defined.

In another aspect the present invention provides a free piston engine comprising at least one free piston formed by a combustion piston and a pumping piston, wherein the pumping piston pumps hydraulic fluid via a fluid circuit to at least one hydraulic motor to convert the motion of said hydraulic fluid to rotary motion and wherein the pump/motor is a "split-cycle" machine as hereinbefore defined.

To more simply explain the functioning of an arrangement of the present invention it is appropriate to assume that the bore of the pumping piston is the same as each of the bores of the working chambers of a split-cycle rotary machine to which the former is hydraulically coupled. Assuming that the maximum piston stroke is to be, say, 36 mm and that the hydraulic coupling is to six working chambers of the split-cycle machine, then 36 mm of travel of the pumping and combustion pistons will reflect 6 mm of travel of each piston in each of six working chambers of the split-cycle machine.

To then control the stroke of the free pumping piston and hence its associated combustion piston,. the hydraulic fluid flow between the pumping piston chamber and any one of the hydraulically coupled six split-cycle machine working chambers may be effected. Control of the free piston motion can be provided as follows by way of example. If movement of the free piston from top dead center to bottom dead center corresponds to movement of the six associated hydraulic pistons in the split-cycle machine from their respective top to bottom dead center positions and vice versa then by the interposition of hydraulic fluid control valves in the hydraulic circuitry the stroke of the free pumping piston and hence the swept volume of its coupled combustion piston can be varied by opening or closing the fluid access to one, some or all of the hydraulically coupled working chambers of the split-cycle machine.

By the method of the present invention a four stroke free piston engine may be coupled to a split-cycle rotary machine such that a plurality of hydraulic pistons may be removed from the fluid coupling during cycles of operation of the engine as required such that it becomes possible to have, say, in the example discussed above 36 mm power and exhaust strokes with 24 mm induction and compression strokes. By such an arrangement there would be provided an 8:1 compression stroke and a 12:1 power stroke. The advantages of providing a four stroke engine which can function in that manner will be readily apparent to persons who are skilled in the art. It will also be possible by the shaping of the lobes on the lobed shafts of the hydraulically coupled split-cycle machine to advantageously control the dwell of the engine piston(s) at top dead center. This ability to control the dwell is in marked contrast with a conventionally cranked engine.

In the present invention the motive force of the engine is transmitted to the rotary shaft of the split cycle machine via a hydraulic fluid coupling to the free piston(s). This hydraulic coupling avoids problems associated with a conventional rotary cranked engine while the free pumping and combustion pistons of the engine are constrained to follow linear motion instead of a cranked motion.

In a particularly preferred embodiment, four internal combustion engine free pistons have their rods hydraulically coupled to four separate sets of six working chambers of a 24 cylinder split-cycle rotary machine which is able to integrate the firings of the four pistons and provide a smooth rotary output.

A further aspect of the present invention provides that each combustion chamber is formed with two opposed free pistons with the mode of combustion being via a two-stroke cycle. Each of the opposed pistons is hydraulically coupled to at least one of the working chambers of a split cycle rotary machine.

By providing opposed free pistons in a common combustion chamber in an arrangement in accord with the present invention, the prospect of providing an infinitely variable control to the motion of those pistons arises. By such means, the compression ratio of the combustion chamber can be varied to accommodate a range of combustible fuels, while infinite adjustability of the exhaust port opening can provide ready control over the performance of an engine.

In this aspect of the present invention, two opposed free pistons are fitted in a common cylinder forming a combustion chamber therebetween, said pistons being mounted to respective piston rods, which are adapted to move linearly within respective hydraulic fluid chambers. Each free piston of each opposed pair being hydraulically coupled to at least one fluid working chamber of a split cycle machine, such that the stroke of each piston of each pair of pistons is controllable by, at least in part, the stroke of each piston of the fluid working chamber(s) of the split cycle machine to which that piston of the pair is hydraulically coupled.

BRIEF DESCRIPTION OF THE DRAWINGS

The present invention will now be described by way of example with reference to the accompanying drawings, in which.

DESCRIPTION OF THE PREFERRED EMBODIMENTS

Figure 1:
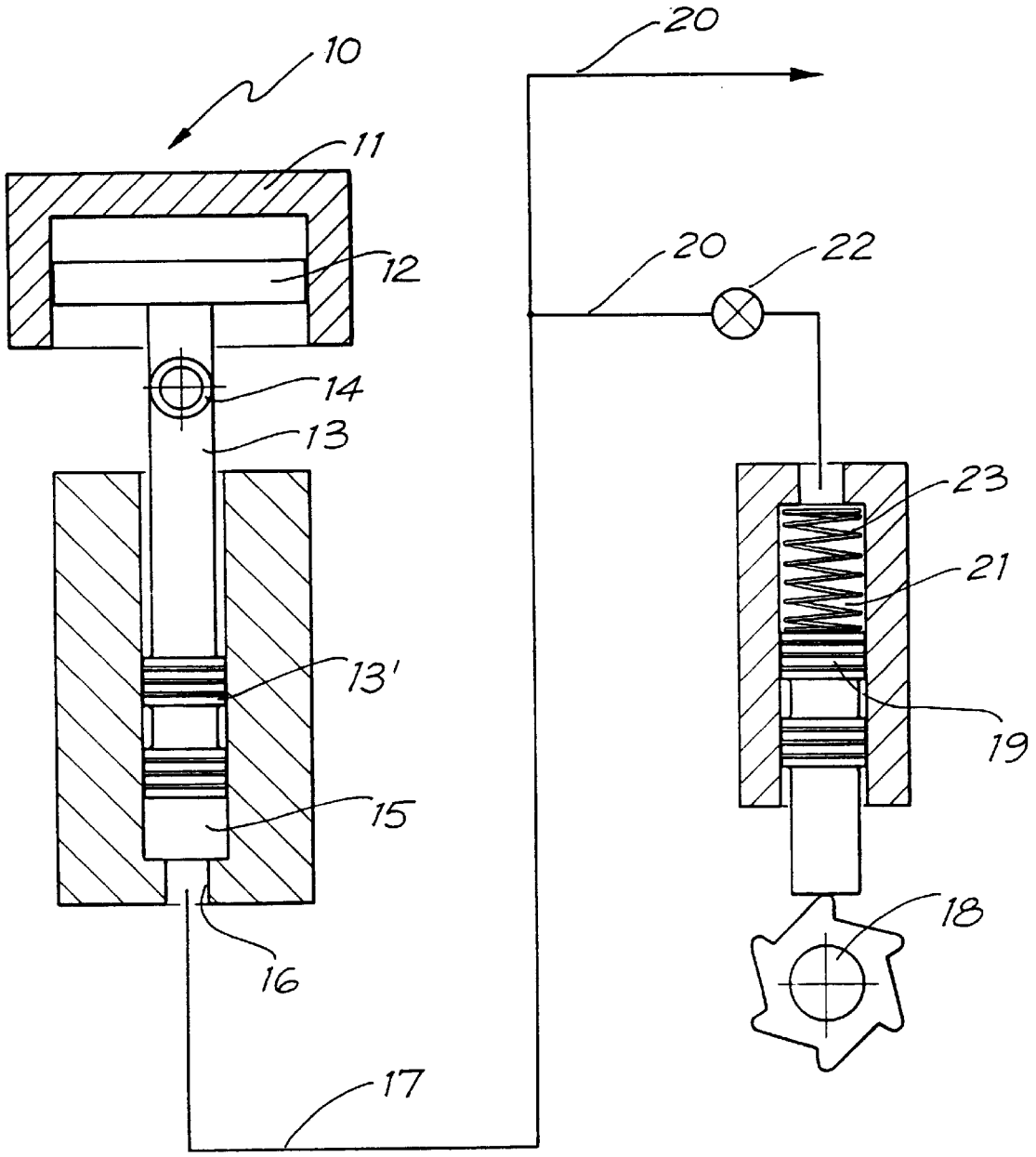
FIG. 1 is a schematic arrangement view to demonstrate the method of hydraulic control of the present invention as applied to a single free piston.

The schematic arrangement of FIG. 1 shows a single cylinder free piston engine 10 having cylinder head 11 containing piston 12. Piston 12 being mounted to a piston rod 13 formed in two parts with a knuckle joint 14 therebetween.

Piston rod 13 itself forms hydraulic pumping piston 13' within hydraulic cylinder 15. Outlet 16 of hydraulic cylinder 15 is coupled via hydraulic line 17 to six working cylinders of a split-cycle rotary machine all operating at the same phase of rotation of lobed shafts 18 which are in contact with respective pistons 19 of the rotary machine. Each fluid coupling via hydraulic line 17 to the split-cycle machine hydraulic cylinder 15 is via respective parallel fluid lines 20 which branch off line 17.

Hydraulic fluid coupling between each of the cylinders or chambers 21 and line 17 is controlled via the operation of respective variably openable valves 22. Valves 22 may be solenoid valves or their equivalents. The single cylinder depicted in FIG. 1 will now be described on the basis that it is a four stroke internal combustion engine controlled to have 36 mm power and exhaust strokes while having 24 mm induction and compression strokes and where the cross-sectional area of the bore of piston 13' is the same as that of each of the bores of the six hydraulic pistons 19.

In this example a 36 mm stroke of piston 12 corresponds to 6 mm strokes for each of six pistons 19. When there has been combustion in engine 10, piston 12 moves with 36 mm over the power stroke of that piston which directly corresponds to the 6 mm movement of the six pistons 19. At the end of the power stroke of piston 12 with that piston at bottom dead center and similarly with pistons 19 at their bottom dead center, the exhaust stroke commences and each of valves 22 are maintained open to hydraulically link chamber 21 with piston 13' via lines 20 and 17. At the end of the exhaust stroke and on commencement of the induction stroke two valves 22 are closed so that only four pistons 19 are hydraulically coupled to piston 13' which then allows piston 12 to only travel through a 24 mm induction stroke. For the two pistons 19 which are not hydraulically coupled to piston 13' during the induction stroke, a fluid addition will be required to their working chambers 21 to avoid suction effects in their respective working chambers. In the schematic of FIG. 1 a spring 23 is shown to provide assistance in returning piston 19 to its bottom dead center.

At the end of the 24 mm induction stroke the compression stroke commences with the two out of circuit pistons 19 remaining that way so that the compression stroke of piston 12 is also limited to 24 mm with the top dead center position of piston 12 remaining constant for all strokes of the engine 10 while the bottom dead center position varying in dependence on the nature of the stroke of the engine.

Figure 2:
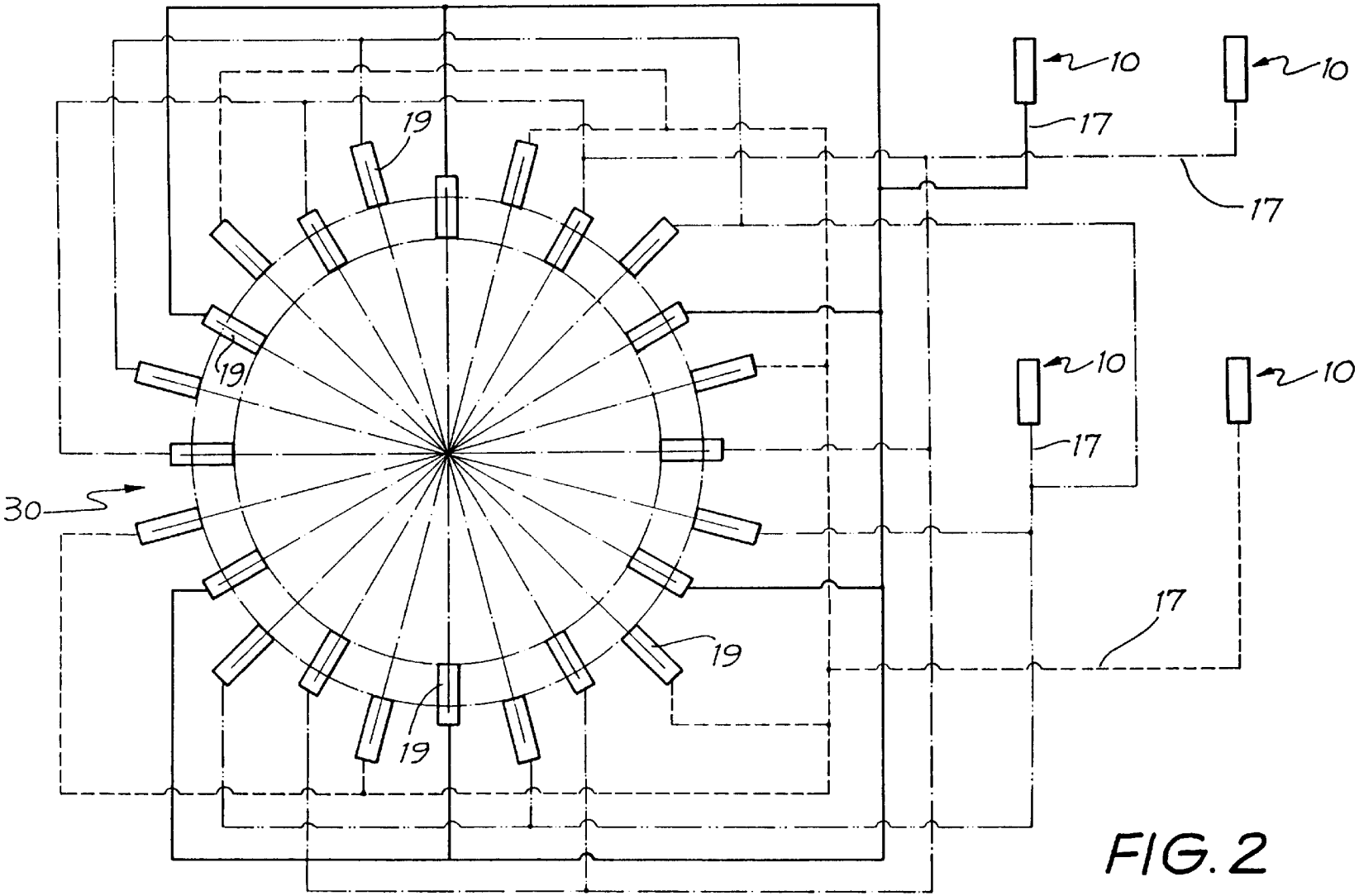
FIG. 2 is a schematic view of a four cylinder free piston engine having cylinders essentially as per FIG. 1 coupled to a 24 cylinder split-cycle rotary machine.

In FIG. 2, the 24 cylinder split-cycle rotary machine 30 is arranged for hydraulic coupling to four engines 10 as exemplified by FIG. 1 with each engine 10 of the arrangement being associated with 6 working chambers of the machine 30. The output of the system is via the central rotary shaft at the axis of machine 30. By this method the hydraulic drive provided by outputs of a four cylinder engine may be harnessed in a way which permits variable control of the various strokes of the pistons of the engine during their cycles of operation.

The piston speeds of the engine cylinders can be limited to give suitable control to the hydraulic transmission of power to and from those cylinders. It is envisaged that the piston speeds of the engine cylinders will be at approximately one quarter of the speed limit of piston motion.

In instances where it may not be necessary to have all four cylinders of the described embodiment operating at the one time, it may be appropriate to shut the operation of one or more cylinders down as a fuel conservation measure. The flexibility, of operation by means of a method and apparatus of the present invention provides enhancements not previously available.

In a further embodiment, by constantly varying the height of one hydraulic piston of the split-cycle machine with respect to the lobes on an instantaneously associated lobed shaft via an actuator it is possible to have an infinitely variable compression ratio and therefore be able to employ computer control to select any desired ratio for any fuel or to compensate for the variable stroke.

In a still further embodiment, by cutting out particular hydraulic cylinders with respect to demand on the engine, e.g. starting off with 6 mm stroke at idle and gradually increasing the stroke up to 36 mm for maximum power then an improved efficiency can be achieved. this is done by continuing to allow the power stroke to be 36 mm and thereby achieving a large expansion ratio especially when combined with variable compression as described above.

The present invention can be effected by driving one hydraulic piston of the split-cycle machine by one free piston.

Even though the first embodiment has been described in relation to a four stroke engine arrangement the method and apparatus of this invention are equally suited to two stroke cycle single or multi-cylinder free piston engines.

Figure 3:
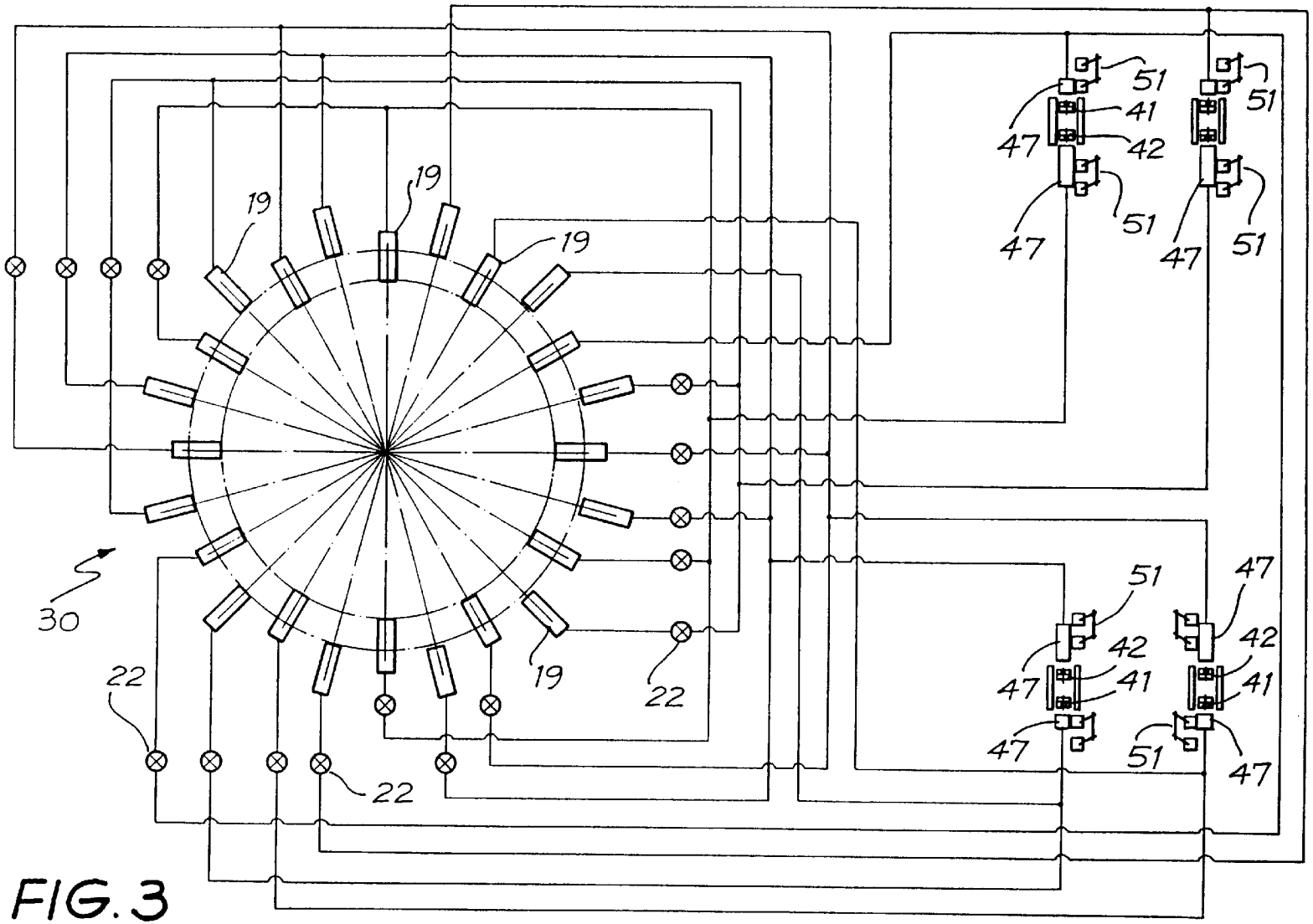
FIG. 3 is a schematic arrangement view showing an hydraulic circuit diagram of another embodiment of the present invention which demonstrates one method of hydraulic control applied to four opposed piston pairs.

FIG. 3 is a view similar to that of FIG. 2 and like components are similarly numbered to those in FIG. 2. In the embodiment of FIG. 3 the opposed pistons 41 and 42 of each piston pair and cylinder combination 40 are coupled to respective hydraulic pistons 43 and 44. Piston 41 controls the opening of exhaust port 45 while the movement of piston 42 provides the major component of the stroke of the engine.

Piston rods 43 and 44 are mounted to respective hydraulic pistons 46 within each hydraulic driving cylinder assembly 47. The side in each hydraulic cylinder assembly 47 opposite respective piston rods 43 is hydraulically coupled to the working chambers and pistons 19 of the split cycle machine 30 via hydraulic circuit lines as depicted. One hydraulic line acted upon by each "exhaust" piston 41 has a high speed solenoid valve 22 interposed in its circuit while the other line is directly coupled to a piston 19.

Each "power" piston 42 in this embodiment is hydraulically coupled to four working chambers 19 with three of those couplings having high speed solenoid valves 22 in parallel with one working chamber 19 being without a high speed solenoid valve.

Figure 4:
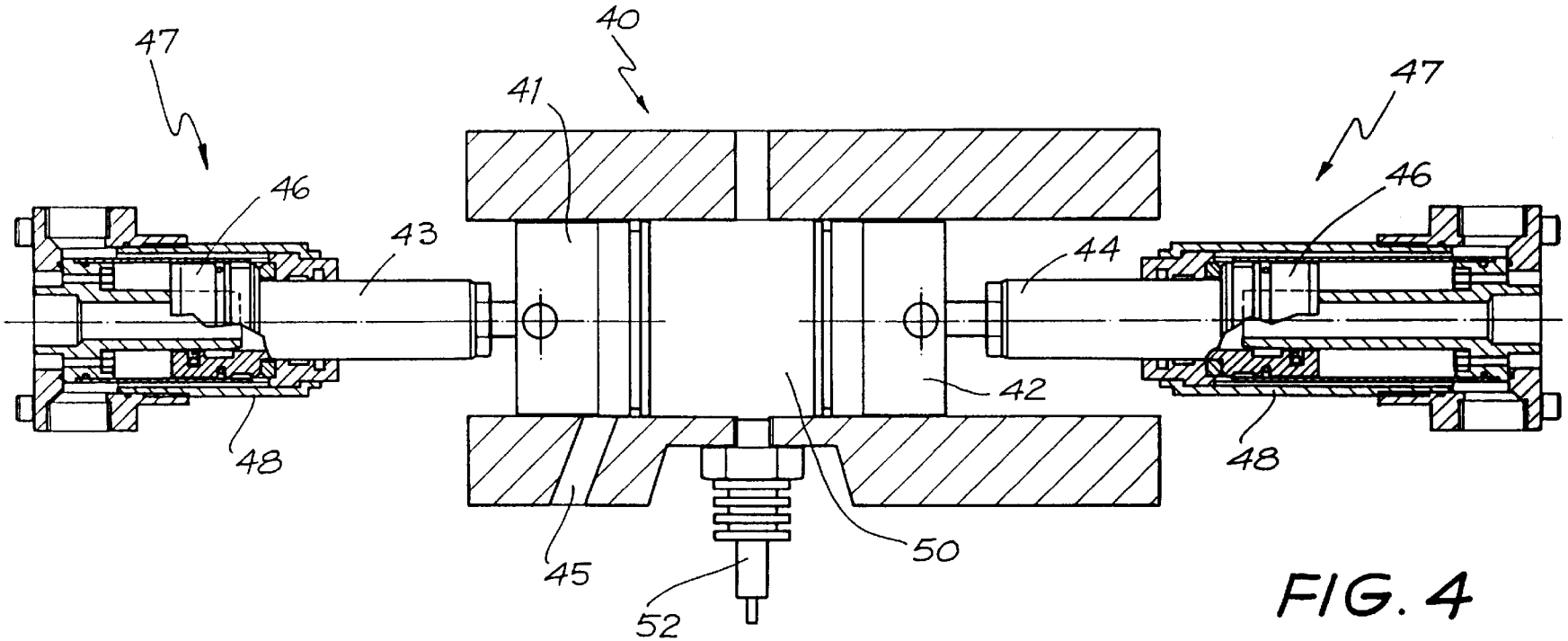
FIG. 4 is a cross-sectional view of one of the opposed piston pairs of FIG. 3 in a first configuration.
Figure 5:
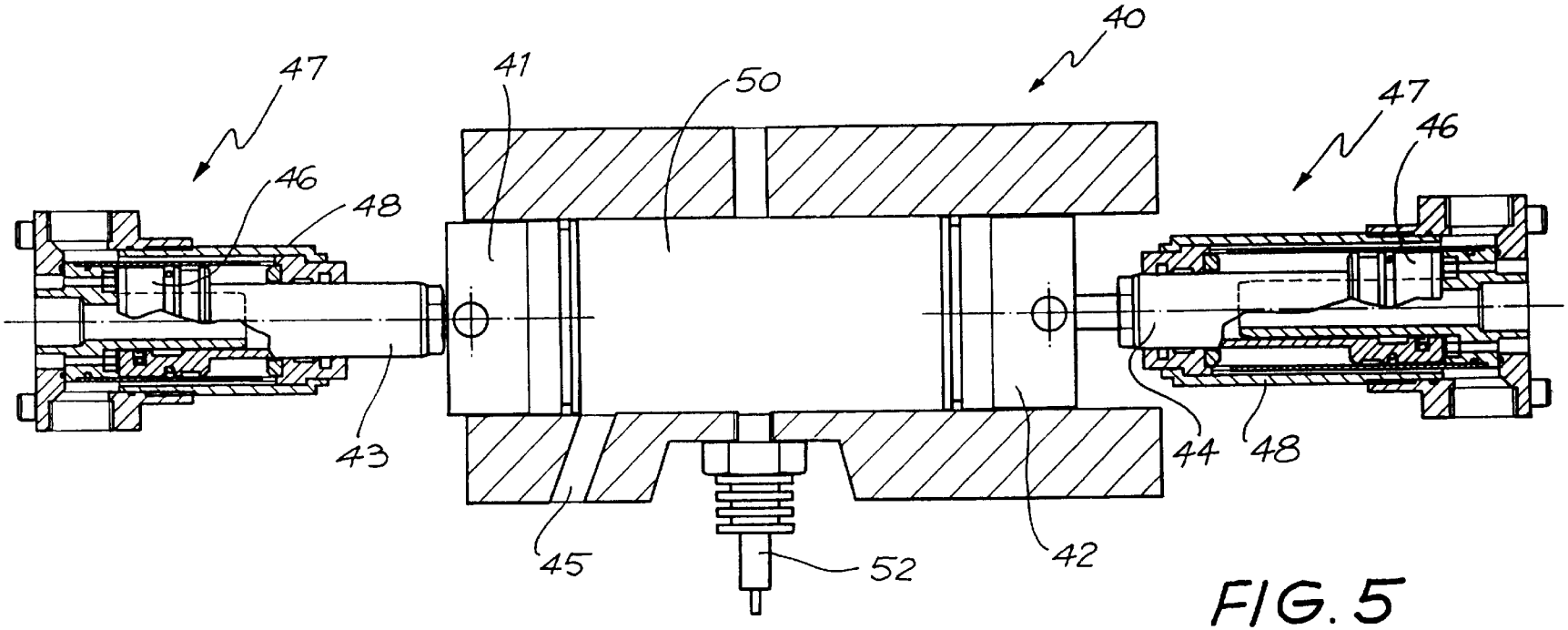
FIG. 5 is a view similar to FIG. 4 with the opposed pistons in a second configuration permitting exhausting of a combustion chamber.

As shown in FIGS. 4 and 5 "exhaust" piston 41 is provided with a 12 mm stroke controlled from two pistons 19 of the machine 30. Each such piston 19 having a 6 mm stroke with the output of one piston 19 being variable by reason of its associated solenoid valve 22 (which correspond to valves 22).

Each body of the hydraulic cylinder assembly 47 is shown mounted to a proportional controller for moving the body 48 of each cylinder assembly 47 toward or away from the combustion chamber 50. By controllably varying the displacement between one body 48 and its associated piston 41 it is possible to provide an infinitely variable opening to exhaust port 45.

By actuating appropriate solenoid valves 22 to cut out particular hydraulic controlling pistons 19 based on the demand of the engine it is possible to provide not only an infinitely variable control to the opening of exhaust port 45 but it is also possible to readily vary the stroke of each "power" piston 42.

As shown in FIGS. 4 and 5 when taken in conjunction with FIG. 3 it is possible, by cutting out particular pistons 19 via respective solenoid valves 22 based upon the demand placed on the output of machine 30, to start with power piston 42 having a stroke of say 6 mm at engine idle speed and to gradually increase the stroke of piston 42 to, say, 24 mm for maximum power. With the stroke of piston 42 being controlled by four separate pistons 19 each having a 6 mm stroke it becomes feasible to infinitely vary the compression ratio by means of varying the separation between the cylinder body 48 and piston 42. Such a facility enables a computer used control system (not shown) to be added to set the compression ratio of each two stroke cylinder comprising opposed pistons 41 and 42. Such control of compression facilitates the use of a range of different fuels in the one engine or may add further variation to the operating cycle of that piston.

In another embodiment (not shown) each of pistons 41 and 42 are connected by associated hydraulic lines to respective separate pistons 19 of machine 30 instead of the depicted form in which each exhaust piston 41 is coupled to two pistons 19 and each compression piston 42 is hydraulically coupled to four pistons 19.

Proportionally controlled actuators 51 whether they be associated with respective cylinder bodies 48 of hydraulic cylinder assemblies 47 as shown in FIG. 3 or be incorporated in the circuity in some other location such as acting to vary the height of followers on one or more of the pistons 19, are able to provide complex control arrangements to control the opening of exhaust ports 45 and/or the compression ratio depending upon the characteristics of the fuel being used and the setting of the spark timing of spark plug 52 via a computerised control system in a manner understood in the art.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A method of converting linear piston motion to rotary output motion in a free piston engine comprising:

providing at least one free piston formed by a combustion piston and a pumping piston;

providing at least one hydraulic motor; and pumping a hydraulic fluid by the action of the pumping piston to the at least one hydraulic motor, which motor converts the motion of the hydraulic fluid to rotary output motion and wherein the motor is a "split-cycle" machine.

2. A method as claimed in claim 1, further comprising forming the free piston engine from at least one pair of opposed free pistons within a common bore such that combustion of fuel occurs in the bore between the at least one pair of pistons.

3. A method as claimed in claim 1 wherein the step of pumping a hydraulic fluid comprises variably controlling a quantity of hydraulic fluid flow between each piston and the "split-cycle" machine.

4. A method as claimed in claim 1, further comprising varying the motion of each free combustion piston in dependence upon the output required from the free piston engine as a function of fuel to be combusted by the engine.

5. A free piston engine comprising at least one free piston formed by a combustion piston and a pumping piston, wherein the pumping piston pumps hydraulic fluid via a fluid circuit to at least one hydraulic motor to convert the motion of the hydraulic fluid to rotary motion and wherein the motor is a "split-cycle" machine.

6. A free piston engine as claimed in claim 5 wherein the engine is formed by at least one-pair of opposed free pistons within a common bore and the portion of the bore between the pistons comprises a combustion chamber.

7. A free piston engine as claimed in claim 5 further comprising a means for varying a quantity of hydraulic fluid in the fluid circuit between the free piston and a hydraulic fluid working chamber of the "split-cycle" machine.

8. A free piston engine as claimed in claim 5 wherein a hydraulic cylinder of the pumping piston is movable relative to a bore of its respective combustion piston to effect changes in a compression ratio of a combustion chamber of the combustion piston.

9. A free piston engine as claimed in claim 7 wherein the means for varying comprises at least one computer controlled solenoid valve in the fluid circuit.

10. A free piston engine as claimed in claim 8, further comprising a means for moving the hydraulic cylinder relative to the bore of its respective combustion piston.

11. A free piston engine as claimed in claim 10, further comprising a means for varying the quantity of hydraulic fluid in the fluid circuit between the free piston and a hydraulic fluid working chamber of the "split-cycle" machine.

12. A free piston engine as claimed in claim 10, wherein the means for moving comprises a proportionally controlled actuator means.

13. A free piston engine as claimed in claim 11, wherein the means for varying comprises at least one computer controlled solenoid valve in the fluid circuit.

14. A free piston engine hydraulically connected to at least one "split-cycle" machine, the free piston engine comprising:

a cylinder head;

a piston contained within the cylinder head;

a hydraulic cylinder; and a piston rod contained within the hydraulic cylinder at one end and connected to the piston at its other end;

wherein the piston rod forms a pumping piston which is configured to pump hydraulic fluid by a fluid circuit to the at least one "split-cycle" machine.

15. The apparatus of claim 14, wherein the piston rod comprises a first part and a second part connected by a pivotal connection.

16. The apparatus of claim 15 wherein the fluid circuit includes a valve.

17. The apparatus of claim 14 wherein the free piston engine is a four stroke internal combustion engine controlled to have 36 mm power and exhaust strokes and 24 mm induction and compression strokes.

18. The apparatus of claim 17 wherein the pumping piston is within a bore having a predetermined cross-sectional area.

19. The apparatus of claim 18, wherein the "split-cycle" machine is of the type which includes at least one hydraulic cylinder which has a bore with a predetermined cross-sectional area, wherein the cross-sectional area of the pumping piston bore is substantially the same as the cross-sectional area of the bore of the hydraulic cylinder of the "split-cycle" machine.

20. The apparatus of claim 14 further comprising a means for varying the quantity of hydraulic fluid in the fluid circuit between the free piston and a hydraulic fluid working chamber of the "split-cycle" machine.

* * * * *